United States Patent [19]

Garrido et al.

[11] Patent Number: 4,823,710

[45] Date of Patent: Apr. 25, 1989

[54] NON-PERIPHERAL BLOWING OF OXYGEN-CONTAINING GAS IN STEAM GENERATING BOILERS

[75] Inventors: Guillermo F. Garrido, St-Bruno; Robert G. H. Lee, Montreal; Derek Hornsey, Beaconsfield; José M. Dieguez, St-Bruno, all of Canada

[73] Assignee: Canadian Liquid Air Ltd.- Air Liquide Canada Ltee., Canada

[21] Appl. No.: 107,174

[22] Filed: Oct. 13, 1987

[51] Int. Cl.[4] ..... F23B 7/00

[52] U.S. Cl. ..... 110/234; 110/297; 110/302; 110/309; 110/313; 110/348; 122/DIG. 7

[58] Field of Search ..... 122/7 C, DIG. 7; 110/297, 302, 309, 313, 314, 188, 298, 347, 300, 251, 205, 234

[56] References Cited

U.S. PATENT DOCUMENTS

| | | | |
|---|---|---|---|
| 409,285 | 8/1889 | Hildreth | 110/300 |
| 1,101,925 | 6/1914 | Harris | 122/2 |
| 1,639,642 | 8/1927 | Law | 110/302 |
| 1,952,227 | 3/1934 | Adams | 110/251 |
| 2,582,808 | 1/1952 | Webb | 110/313 |
| 2,642,019 | 6/1953 | Cushing et al. | 110/314 X |
| 3,699,903 | 10/1972 | King | 110/347 X |
| 4,335,660 | 6/1982 | Maloney et al. | 110/205 X |
| 4,462,319 | 7/1984 | Larsen | 122/7 C |

*Primary Examiner*—Edward G. Favors
*Attorney, Agent, or Firm*—Lee C. Robinson, Jr.

[57] ABSTRACT

In a steam generating boiler having a bottom wall supporting a char bed and sidewalls with ports through which air is admitted for combustion of combustible species in the char bed and emanating therefrom, combustion is improved by introducing an oxygen-containing gas into a lower central zone of the boiler, from at least one point remote from the sidewalls to thereby cause intimate mixing of the oxygen contained in the gas with the combustible species.

81 Claims, 7 Drawing Sheets

20"
68
44
40
34
38
42
60
62
36
64
66
58
24
26
56
50
32
70'
48
54
52
33
46
22'
28
30
98
100
108
110
106
26'
104
102
98"
104'
102"

NON-PERIPHERAL BLOWING OF OXYGEN-CONTAINING GAS IN STEAM GENERATING BOILERS

BACKGROUND OF THE INVENTION

The present invention relates to improvements in steam generating boilers. More particularly, the invention is directed toward improving combustion conditions in steam generating boilers such as the recovery boilers which are used in the pulp and paper mills for the combustion of spent liquor from sodium-based pulping process.

The main objectives in operating a recovery boiler are to recover the pulping chemicals in the reduced state and to recover the heat released by the combustion of carbonaceous material to generate steam for the process. The spent liquor from the pulping process is sprayed in small drops over the cross-section of the boiler furnace through the upwardly flowing combustion gases so as to dry the liquor droplets to a concentration where the heat value. of the char material with the residual moisture is sufficient to keep a reasonably stable combustion going. The dry liquor solids settle on the bottom of the boiler forming a carbonaceous char bed. The char bed has two functions: to reduce the spent chemicals for further recycle and to supply heat by reacting with the oxygen in the air being blown horizontally over the char bed.

In such boilers, the air is introduced peripherally through ports located in the boiler sidewalls and into the lower section of the boiler. In most designs, the total air supply is divided in two or more streams which are introduced peripherally at different levels of the boiler. These air streams are referred to as primary, secondary and tertiary air, conventionally starting from the bottom of the boiler.

Because of the influence of the induced draft fan and of the large size of the boiler, only a very small fraction of the peripherally introduced air reaches the central region of the boiler's cross-section.

Peripheral air is introduced either horizontally or slightly downwardly at subsonic velocities ranging from about 25 to 100 m/sec, which causes an upward deflection of the air along the walls of the boiler.

In cases where the fuel which supplies heat for the steam generation is concentrated towards the center of the boiler's cross-section, such as in the case where a char bed containing carbonaceous materials sits on the bottom of the boiler, the peripherally introduced air will not readily combine with the combustible species, either gaseous or finely divided solids, resulting in poor combustion in the lower section of the boiler.

A fundamental limitation to the burning capacity of these boilers is due to such poor mixing between the combustible species and the oxygen required as a comburant. As the air is introduced peripherally through sidewall ports and blown into the lower section of the boiler, due to the relative low pressure and subsequent low velocity of the air flow, there is a preferential upward flow along the sidewalls, leading to poor mixing with the combustible species.

The lack of intimate mixing of air with the combustible species in the lower section of the boiler limits its capacity not only because heat transfer to the boiler tubes is poor since peripheral air behaves as a coolant, but also because the lack of mixing lengthens the combustion zone, resulting in a vertical temperature profile which promotes carry over of unreacted inorganic material and in unnecessarily higher temperatures in the upper section of the boiler, where screen tubes and superheater tubes are located.

Layers of carried over deposits on the screen and superheated tubes can be over 20 mm thick, thus drastically obstructing heat transfer and reducing the sectional area for the passage of gases, eventually bottlenecking the boiler when the high pressure drop through the upper section limits the air blowing capacity of the boiler, forcing scheduled or non-scheduled shut-downs for deposit removal.

Another problem associated with poor mixing of the air with the combustible species is the emission of reduced sulfur species in the exit gas. In conventional boilers, eventhough an overall $O_2$ excess of over 2% may exist in the exit gas, some reduced sulfur species mix with the available oxygen only at the top of the boiler, where not enough time is available for a complete oxidation to occur and/or the gases are already at a lower temperature than necessary for complete oxidation.

From a thermochemical equilibrium view point, as long as there is more than 1% vol. $O_2$ in the flue gases exiting the boiler furnace, there should be less than 20 ppm total reduced sulfur (TRS) species. However, because of imperfect gas mixing, equilibrium is not attained and therefore oxygen and combustible species coexist in the flue gases.

A better mixing of oxygen and the combustible species would modify the vertical temperature profile of the boiler resulting in a temperature increase in the lower section of the boiler and consequent shorter combustion zone and lower exit gas temperature in the upper section of the boiler with the following advantages:

1. Reduction of carried over deposits.
2. Lowering of TRS emissions at similar excess $O_2$ in flue gas.
3. Increased chemical recovery capacity.
4. Increased steam generating capacity.
5. Reduced shut-down frequency for deposit removal.
6. Smoother boiler operation.

Enriching the combustion air with oxygen would further allow burning capacity increases without subsequent increase in carry over deposits due to lower gas velocities relative to air combustion.

SUMMARY OF THE INVENTION

It is therefore an object of the present invention to improve the air distribution in the lower section of a steam generating boiler so as to provide intimate mixing of the air with the combustion species, thereby improving combustion.

In accordance with one aspect of the invention, there is provided a method of improving combustion in a steam generating boiler having a bottom wall supporting a char bed and sidewalls with ports through which air is admitted for combustion of combustible species in the char bed and emanating therefrom, which comprises introducing an oxygen-containing gas into a lower central zone of the boiler, from at least one point remote from the sidewalls to thereby cause intimate mixing of the oxygen contained in the gas with the combustible species.

According to a further aspect of the invention, there is also provided in a steam generating boiler having a bottom wall supporting a char bed and sidewalls with ports through which air is admitted for combustion of combustible species in the char bed and emanating therefrom, the improvement which comprises means for blowing an oxygen-containing gas into a lower central zone of the boiler, from at least one point remote from the sidewalls to thereby cause intimate mixing of the oxygen contained in the gas with the combustible species.

Applicant has found quite unexpectedly that by introducing an oxygen-containing gas into the lower central zone of the boiler, remotely from the sidewalls of the boiler, a better mixing of oxygen and combustible species could be achieved and that the oxygen deficient zone which is characteristic of boilers where air is introduced only peripherally through sidewall ports could be greatly reduced as a result of the improved mixing of the oxygen with the combustible species. This improvement can be attained without disrupting the char bed formation which is essential to achieving chemical recovery. Due to the resulting temperature increase in the lower section of the boiler, oxidation of $Na_2S$, $H_2S$ or organic sulfides would occur in that section of the boiler, thereby lowering TRS emissions.

Examples of suitable oxygen-containing gases which can be introduced non-peripherally include air, oxygen-enriched air and mixtures of oxygen with other gases such as $N_2$, $CO_2$, CO, $CH_4$, $C_3H_8$, natural gas, $H_2O$ vapour, $N_2O$, flue gases, etc. It is of course also possible to use commercial $O_2$ having a molecular oxygen content generally between 90 and 99.5% by volume. On the other hand, where the oxygen-containing gas comprises a mixture of $O_2$ and $CO_2$, such a gaseous mixture is preferably nitrogen-free, that is, having a $N_2$ content of less than about 4% by volume, so as to enable the $CO_2$ to be recovered. Preferably, up to about 60% of the total oxygen requirement is introduced via the non-peripheral blowing of the oxygen-containing gas, the balance being supplied in the form of air introduced peripherally through the sidewall ports.

The oxygen-containing gas can be introduced nonperipherally by blowing the gas either downwardly from an upper section of the boiler or upwardly from above the char bed, or by a combined blowing of the gas both downwardly from an upper section of the boiler and upwardly from above the char bed. The oxygen-containing gas can be blown at any pressure, from atmospheric (when a negative pressure exists in the boiler because of an induced draft fan) to about 10 atm., the preferred pressure range being between about 1.2 and about 5 atm. (absolute). Thus, the gas velocity can range from about 1 ft/sec to over sonic velocity, preferably from about 10 to about 1000 ft/sec.

The oxygen-containing gas is conveniently blown downwardly by means of at least one elongated lance arranged in the upper section of the boiler and extending downwardly to discharge through at least one orifice thereof at least one stream of the oxygen-containing gas, remotely from the sidewalls of the boiler. For example, a single lance can be suspended from the top of the boiler to extend vertically and centrally of the boiler, or can be mounted in the so-called "bull nose cavity" of the boiler, in which case the lance is angularly inclined. Such a lance is preferably provided with a plurality of discharge orifices spaced from one another and each oriented at an angle not greater than about 60° relative to the longitudinal axis of the lance. On the other hand, where a plurality of lances are used, the lances can be evenly distributed relative to a central vertical axis of the boiler or they can extend in a common plane, in spaced-apart parallel relationship; in the latter case, the lances may extend either vertically or at an angle relative to the vertical.

Upward blowing of the oxygen-containing gas, on the other hand, is advantageously effected by means of at least one injector arranged on the bottom wall of the boiler remotely from the sidewalls thereof and extending through the char bed. Preferably, the injector protrudes from the surface of the char bed immediately surrounding the injector a distance ranging from about 1 cm to about 30 cm, so as to not interfere with the chemical reactions occurring in the char bed and to prevent blockage of the gas discharge orifice of the injector by the liquid smelt.

According to a particularly preferred embodiment, the injector comprises an elongated conduit of temperature and corrosion resistant metal extending through the bottom wall, and a protective refractory structure surrounding the conduit, the conduit and refractory structure coextending from the bottom wall to above the char bed.

The protective refractory structure should be made of a refractory material which is chemically resistant to the smelt and capable of mechanically withstanding impacts caused by falling deposits from the upper section of the boiler. Examples of suitable refractory materials include alumina, silica, silicon carbide, magnesite and chrome-magnesite.

In the case where a single injector is used, it is preferably disposed centrally of the boiler. In the case of a plurality of injectors, on the other hand, these are preferably arranged to impart a swirling motion to the oxygen-containing gas.

It is also possible to pneumatically inject with the lance and/or injector particulate solids which can act as seeds to cause agglomeration of volatilized inorganic matter, or as a source of heat to control furnace or char bed temperature, the oxygen-containing gas further serving in this case as a carrier gas. Such injection of particulate solids is also useful in removing accretion build-up from the gas discharge orifices of the lance or injector. For example, particles of sodium sulfate can be used as agglomeration seeds whereas particles of carbonaceous materials such as coal or sawdust can be used as a source of heat. However, where use is made of coal particles, the carrier gas should not contain more than about 21% vol. oxygen.

The present invention finds application not only in recovery boilers used in pulp and paper mills, but also in other types of steam generating boiler such as those operated in coal fired power plants and boilers burning any mixture of biomass, hydrocarbons, fossils or by-product fuels for the purpose of generating steam and optionally recovering chemicals.

BRIEF DESCRIPTION OF THE DRAWINGS

Further features and advantages of the invention will become more readily apparent from the following description of preferred embodiments as illustrated by way of example in the accompanying drawings, in which.

DESCRIPTION OF PREFERRED EMBODIMENTS

Figure 1:
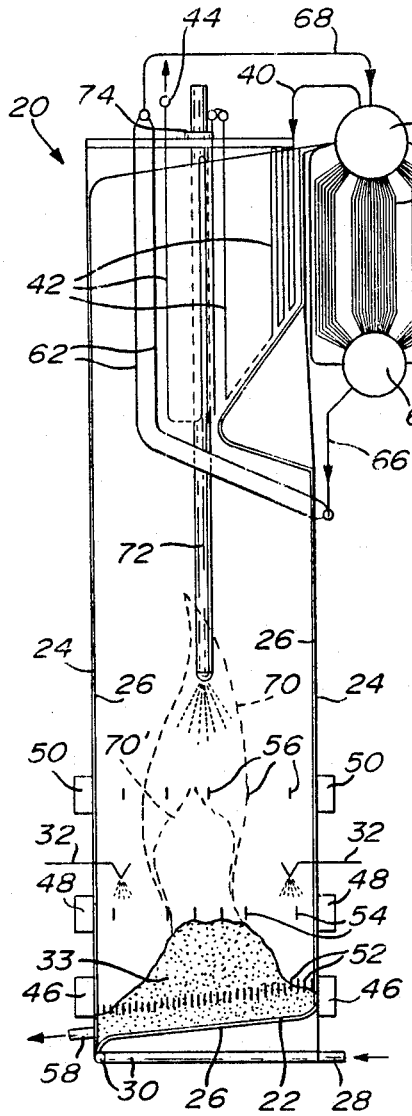
FIG. 1 is a schematic vertical cross-section of a kraft recovery boiler equipped with a top blowing lance according to the invention.

Referring first to FIG. 1, there is illustrated a kraft recovery boiler generally designated by reference numeral 20 and seen having a slanted bottom wall 22 and vertical sidewalls 24. The bottom wall 22 is formed of closely spaced tubes 26 with welded fins therebetween whereas the sidewalls 24 are lined with similar tubes 26 allowing circulation of water introduced through inlet 28 and fed to manifold 30 for distribution to the tubes 26. Black liquor from the kraft pulping process is sprayed by means of spray nozzles 32 in small drops to collect as black liquor dry solids in a char bed 33 supported by the bottom wall 22. As water rises through the tubes 26, it is gradually heated by the heat released by the combustion of the black liquor solids and vaporizes into steam to be collected in the upper drum 34 of the boiler tube bank 36 comprising a plurality of boiler tubes 38. Saturated steam is then sent from the upper drum 34 via line 40 to superheater tubes 42 for the generation of high-pressure dry steam which is discharged at the outlet 44 and may be used at various points in the pulp and paper mill.

Air for the combustion of the black liquor solids is supplied at three different levels in the boiler, by means of primary, secondary and tertiary windboxes 46,48 and 50 which respectively blow primary, secondary and tertiary air through ports 52,54 and 56 provided in the sidewalls 24. The primary air is blown through ports 52 and which may account for up to 60% of the total air supply serves to control the height and shape of the char bed 33. The char bed is a mixture of inorganic salts and carbonaceous materials which provides a reducing environment to chemically reduce sodium sulfate to sodium sulfide and sodium hydroxide to sodium carbonate, the active chemicals in the liquid smelt produced and discharged through spout 58. These chemicals are subsequently recycled to the digestion stage of the pulp mill for the treatment of incoming wood.

The secondary air which is blown through ports 54 may account for up to 50% of the total air supply and provides the oxidant which first meets the incoming black liquor from the spray nozzles 32. Besides causing flash dehydration of the black liquor salts, it supplies oxygen to burn carbon monoxide formed at the char bed 33 and should oxidize the reduced sulfur species either contained in the black liquor or generated during the combustion of dry solids.

The tertiary air blown through ports 56 supplies the balance of air needed to attain an excess $O_2$ in the exit gas represented by the arrow 60. The $O_2$ concentration in the exit gas varies in practice from about 0.1 to about 6% by volume, but for the purpose of the present invention it is preferably within the range of 1.0 to 2.5% by volume. The purpose of the tertiary air is to take to completion the oxidation of combustible species emanating from the lower section of the boiler 20.

Hot gases and entrained volatilized matter are carried to the upper section of the boiler 20. As temperature decreases, the volatilized matter forms crusty deposits on screen tubes 62 and the boiler must therefore be periodically shut down to remove such deposits. The screen tubes 62 form an independent hot water circuit which takes hot water from the lower drum 64 via line 66 and discharges steam via line 68 into the upper drum 34 of the boiler tube bank 36.

The hot gases containing mainly nitrogen, carbon dioxide and water vapor from the combustion of organic matter also carry ash and chemical fumes, which after the superheater tubes 42, cross the boiler tubes 38 and enter an economizer (not shown). The economizer is a heat exchanger which uses the sensible heat in the exit gas 60 to indirectly preheat the feed water before it reaches the boiler tubes 38 and subsequently the water introduced through the inlet 28 at the bottom of the boiler 20.

A fundamental characteristic of traditional steam generating boilers which limits efficient burning of combustible species is the lack of intimate mixing of the secondary and tertiary air supplies with the intermediate products of combustion. The low velocity air tends to flow upwards peripherally along the sidewalls 24, resulting in a relatively cold gas containing large $O_2$ excess. In the central zone, an $O_2$ defficient plume 70 forms which may reach as high as the screen tubes 62 before complete mixing with the peripheral lean gas takes place.

The delayed mixing has important detrimental effects for the boiler operation. Should intimate mixing take place at the tertiary air level, or not too high over it, complete combustion would be attained, thus the longitudinal temperature profile would change, resulting in a shorter but hotter combustion zone, with a subsequent lower temperature at the upper section of the boiler.

In order to overcome these drawbacks and to reduce the oxygen-defficient zone 70, an oxygen-containing gas is blown downwardly into the lower central zone of the boiler by means of a water-cooled lance 72 suspended from the top of the boiler by a retaining collar 74 and arranged centrally of the boiler. An oxygen-containing gas such as air or oxygen-enriched air is thus blown centrally into the lower section of the boiler, thereby causing intimate mixing of oxygen with the combustible species and resulting in a much shorter $O_2$-defficient plume 70'.

Figure 2:
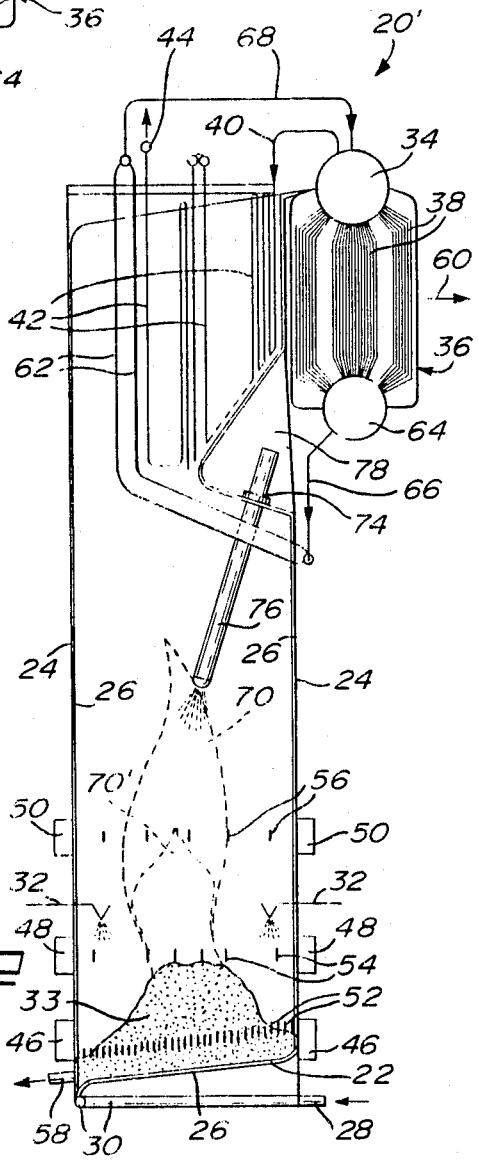
FIG. 2 is a view similar to FIG. 1, illustrating a different location of the lance.

Instead of positioning the lance 72 vertically and centrally of the boiler, it is also possible to mount a shorter lance 76 in the so-called bull nose cavity 78 of the boiler, as shown in FIG. 2. In this case, the lance 76 is angularly inclined and still provides non-peripheral downward blowing of oxygen-containing gas into the lower central zone of the boiler 20'.

Figure 3:
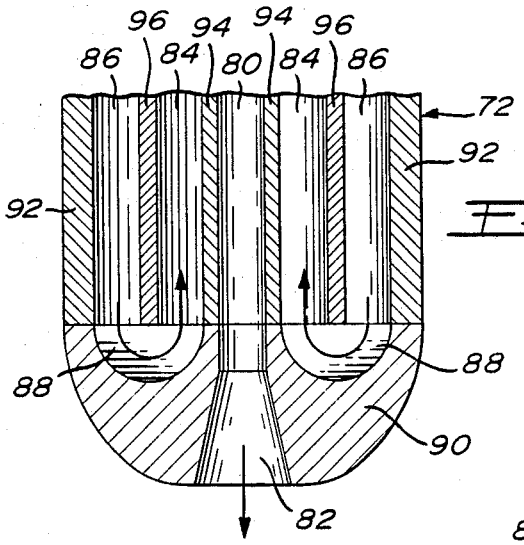
FIG. 3 is a fragmentary section view of the lance shown in FIGS. 1 and 2, illustrating the discharge end thereof.

FIG. 3 illustrates the structure of the water-cooled lance 72, which may also be the same for the lance 76 shown in FIG. 2. As shown, the lance 72 is formed with a central conduit 80 for conveying the oxygen-containing gas, which merges with an outwardly diverging gas discharge orifice 82. Two concentric tubular conduits 84 and 86 are provided for circulating water to cool the lance, the conduits 84 and 86 communicating with one another at their lower ends by means of an annular elbow 88 formed in the tip 90 of the lance. The lance tip 90 can be made of a high thermally conductive metal, such as copper or a copper alloy. The outer wall 92 of the lance, on the other hand, can be made of corrosion resistant metal such as a ferrous alloy (e.g. stainless steel), whereas the inner walls 94 and 96 can be made of thermally conductive metal such as carbon steel, for adequate cooling.

Figure 5:
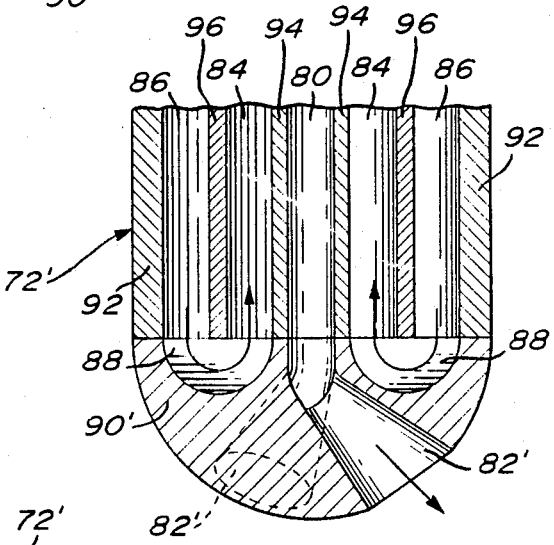
FIG. 5 is a fragmentary section view taken along line 5—5 of FIG. 4.
Figure 4:
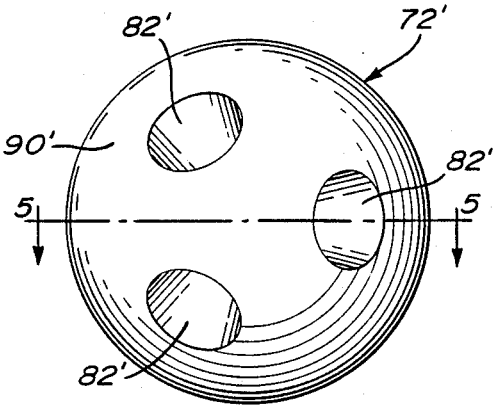
FIG. 4 is a bottom view of a lance according to another preferred embodiment.

FIGS. 4 and 5 illustrate the discharge end of a similar water-cooled lance 72', but having a modified tip 90'. As shown, the tip 90' is formed with three gas discharge orifices 82' equidistantly spaced from one another and each oriented at an angle of about 45° relative to the longitudinal axis of the lance.

Figures 6, 10, 11, 12:
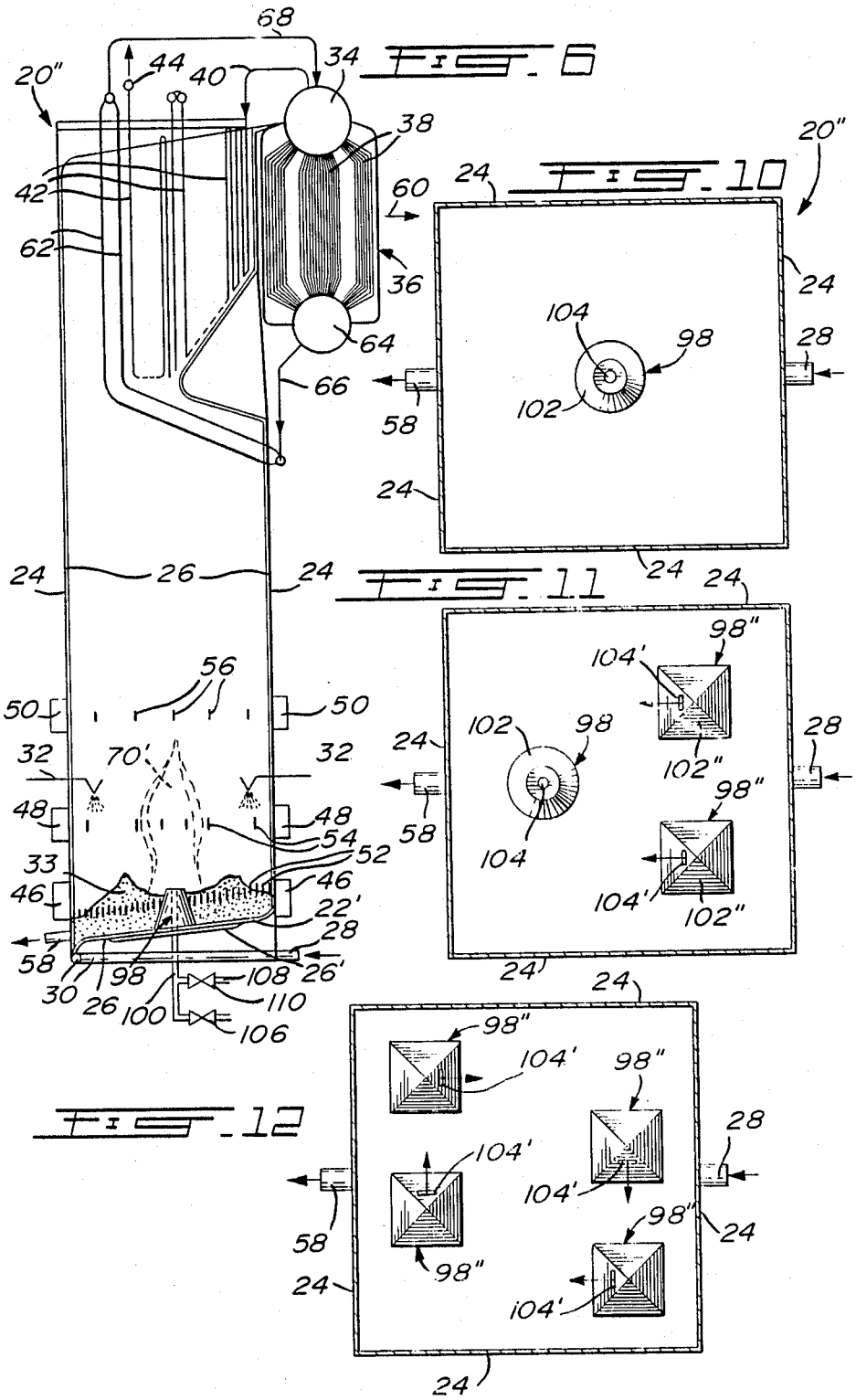
FIG. 6 is a schematic vertical cross-section of a kraft recovery boiler equipped with a bottom blowing injector according to the invention.
FIGS. 10, 11 and 12 which are on the same sheet as FIG. 6 are schematic horizontal section views illustrating different arrangements of injectors.
Figure 7:
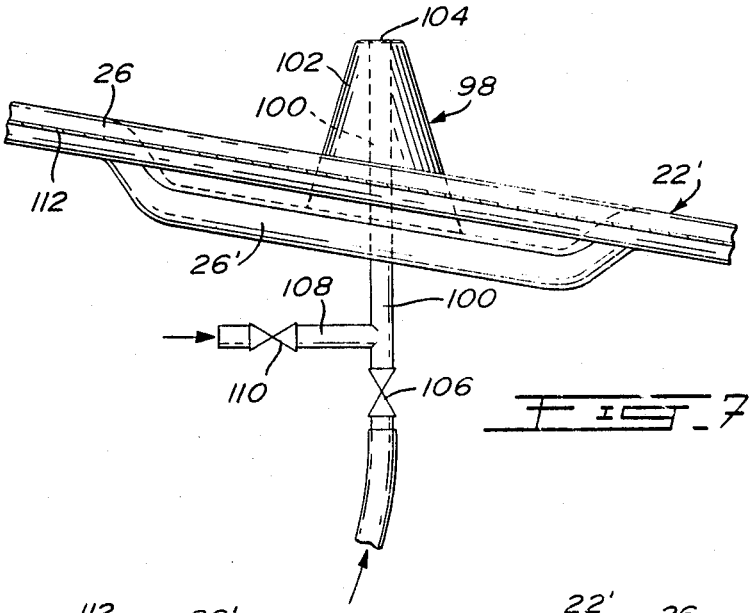
FIG. 7 is a fragmentary vertical section view illustrating the injector shown in FIG. 6.

In the recovery boiler 20" illustrated in FIG. 6, the non-peripheral blowing of oxygen-containing gas is effected by blowing the gas upwardly from above the char bed 33 into a substantially gaseous phase by means of an injector 98 arranged on the bottom wall 22' and extending through and above the char bed 33. The injector 98 comprises an elongated conduit 100 extending through the bottom wall 22' for conveying the oxygen-containing gas and a protective refractory structure 102 surrounding the conduit 100, as best shown in FIG. 7. The conduit 100 and refractory structure 102 coextend from the bottom wall 22' to above the char bed 33. The refractory structure 102 has a conical configuration, the gas discharge orifice 104 being located at the apex of such a conical structure. The flow of oxygen-containing gas can be regulated by means of the valve 106. Where the oxygen-containing gas is air and it is desired to enrich the air with oxygen, molecular oxygen can be admixed via the conduit 108 connected to conduit 100 and provided with a valve 110 for regulating the flow of molecular oxygen admixed.

Figure 8:
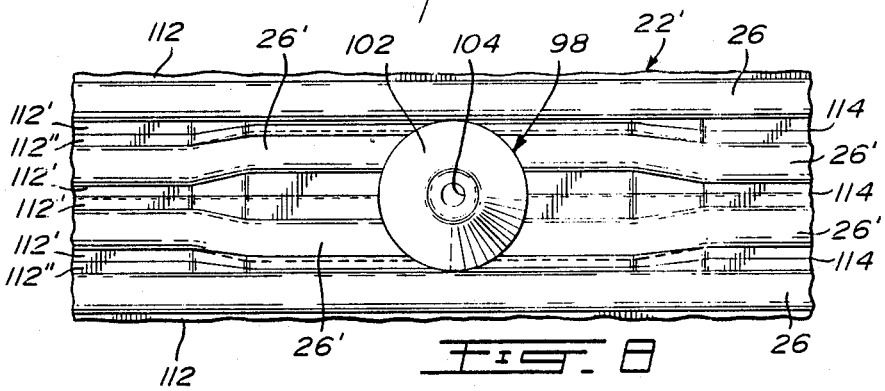
FIG. 8 is a fragmentary top view of the injector shown in FIG. 7.

The bottom wall 22' is formed of closely spaced tubes 26 with welded fins 112 therebetween, as is the bottom wall 22 shown in FIGS. 1 and 2. However, in order to install the injector 98 and enable the conduit 100 thereof to extend between the bottom wall tubes, the two tubes 26' immediately adjacent the conduit 100 are bent downwardly and outwardly to provide sufficient spacing for accommodating the conduit 100; as best shown in FIG. 8. In order to also allow thermally induced deformations, the fins connected to the tubes 26' are made in two parts 112' and 112" which are movably engaged with one another by means of a tongue and groove arrangement 114.

Figure 9:
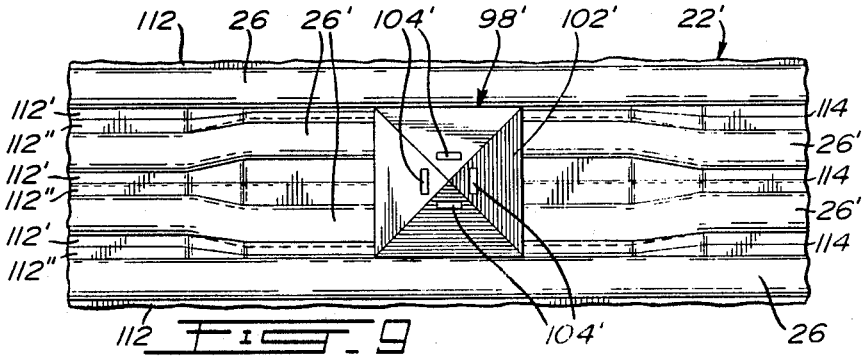
FIG. 9 is a view similar to FIG. 8, illustrating an injector according to another preferred embodiment.

FIG. 9 illustrates a similar bottom injector 98' with a protective refractory structure 102' having a pyramidal configuration. As shown, the injector 98' is provided with four gas discharge orifices 104', one in each of the four upwardly converging sidewalls of the pyramidal refractory structure 102'.

As shown in FIG. 10, the injector 98 is arranged centrally of the boiler 20" so as to blow the oxygen-containing gas vertically upwardly in the center of the boiler. It is also possible to arrange the injector 98 off-center and to install two pyramidal-type injector 98" each having a single gas discharge orifice 104' in the refractory structure 102" thereof such as to blow two streams of oxygen-containing gas angularly upwardly in a direction toward the vertical stream of oxygen-containing gas blown by the injector 98, as shown in FIG. 11. Four pyramidal-type injectors 98" can also be arranged in a manner such that the respective gas discharge orifices 104' thereof blow a stream of oxygen-containing gas angularly upwardly while imparting to the oxygen-containing gas a swirling motion, as shown in FIG. 12.

It should be noted in connection with the embodiments illustrated in FIGS. 1 and 2 that the lance 72 or 76 need not necessarily be water cooled as other types of cooling means can be utilised. For instance, the lance can comprise a first tubular conduit for blowing the oxygen-containing gas and a second tubular conduit concentrically arranged with respect to the first conduit to define a channel of annular cross-section surrounding the first conduit for blowing a gas shrouding the oxygen-containing gas. The shrouding gas can be any gas or mixture of gases which may serve as a coolant or as a gaseous shield to protect the tip of the lance from $O_2$ attack. Examples of shrouding gas which may be used to this end include air, argon, $N_2$, $CO_2$, CO, $CH_4$, $C_3H_8$, $H_2O$ vapour and flue gases.

With respect to the embodiments shown in FIGS. 8–12, the refractory structure 102, 102' or 102" is entirely optional since when the $O_2$ concentration of the oxygen-containing gas blown by the injector 98,98' or 98" is less than about 35% by vol., a single steel pipe is adequate.

Figure 13:
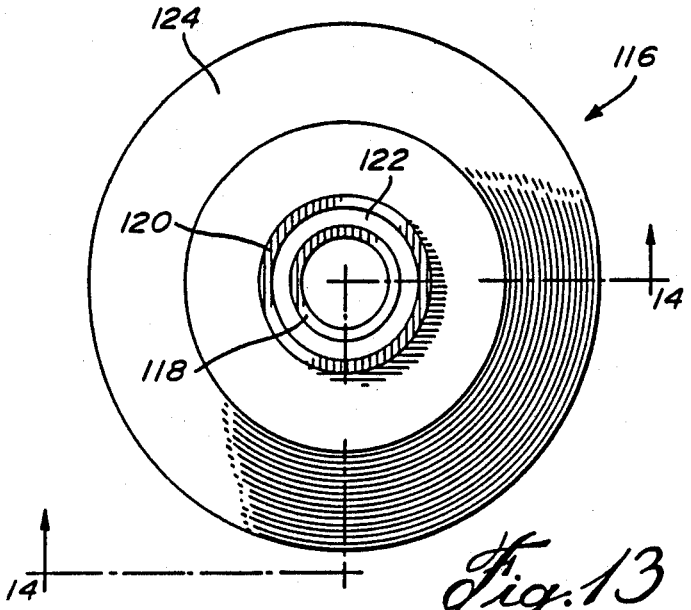
FIG. 13 is a top view of a conical-type double conduit injector.
Figure 14:
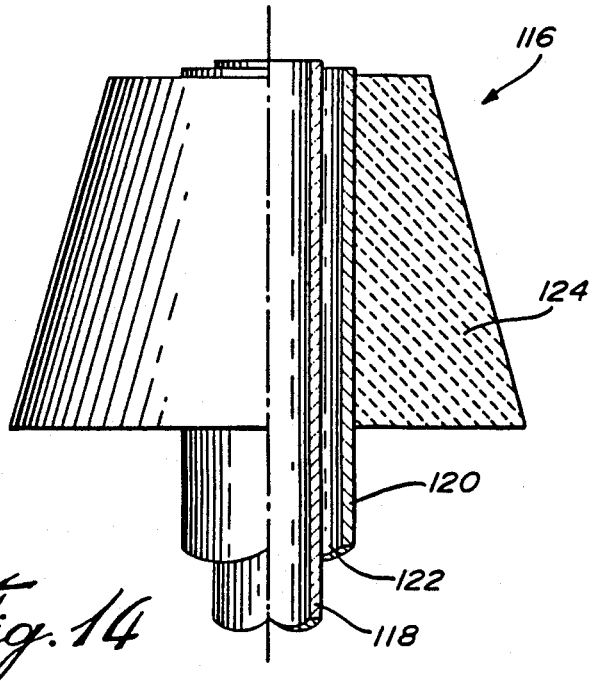
FIG. 14 is a sectional view taken along line 14—I4 of FIG. 13.

For $O_2$ concentrations of 35% by vol. and over, use can be made of a conical-type double conduit injector 116 illustrated in FIGS. 13 and 14. As shown, the injector 116 comprises a first tubular conduit 118 of temperature and corrosion resistant metal for blowing the oxygen-containing gas and a second tubular conduit 120 of temperature and corrosion resistant metal concentrically arranged with respect to the first conduit 118 to define a channel 122 of annular cross-section surrounding the first conduit 118 for blowing a gas shrouding the oxygen-containing gas, the conduits 118, 120 coextending through the bottom wall 22' and char bed 33 illustrated in FIG. 6. A protective refractory structure 124 of conical configuration surrounds the second conduit 120, the refractory structure 124 and conduit 120 coextending from the bottom wall 22' through the char bed 33.

When solid carbonaceous or oxygen reactive materials are pneumatically injected into the boiler, a concentric double conduit type injector 116 as described above can be advantageously utilized, wherein a gas which is non-reactive to the solid carbonaceous or oxygen reactive materials is used as a carrier and blown together with the solid carbonaceous or oxygen reactive materials through the central conduit 118 while the oxygen-containing gas is blown through the annular channel 122 defined between the conduits 118, 120. The carrier gas can consist of a hydrocarbon gas or a gaseous mixture of hydrogen, carbon monoxide and hydrocarbons. It is also possible to inject the solid carbonaceous or oxygen reactive materials through the central conduit 118 by means of a liquid hydrocarbon, the oxygen-containing gas being blown through the annular channel 122 between the conduits.

Figure 15:
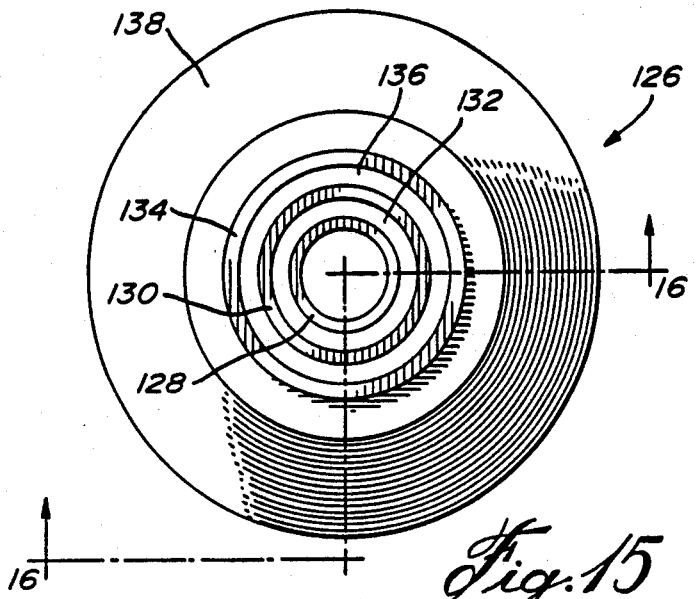
FIG. 15 is a top view of a conical-type triple conduit injector.
Figure 16:
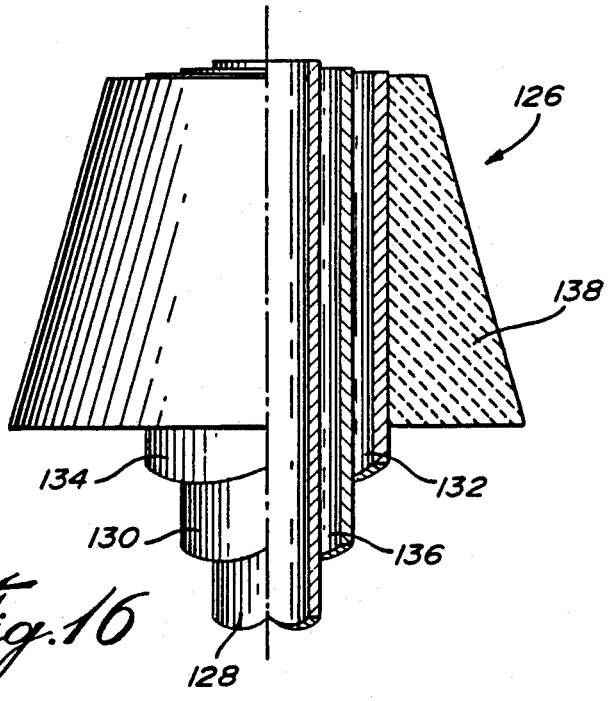
FIG. 16 is a sectional view taken along line 16—16 of FIG. 15.

According to a further preferred embodiment, use can be made of a conical-type triple conduit injector 126 illustrated in FIGS. 15 and 16. As shown, the injector 126 comprises a first tubular conduit 128 of temperature and corrosion resistant metal for pneumatically injecting a solid oxygen-reactive material in particulate form with a carrier gas which is non-reactive to the oxygen reactive material, a second tubular conduit 130 of temperature and corrosion resistant metal concentrically arranged with respect to the first conduit 128 to define a first channel 132 of annular cross-section surrounding the first conduit 128 for blowing the oxygen-containing gas, and a third tubular conduit 134 of temperature and corrosion resistant metal concentrically arranged with respect to the second conduit 130 to define a second channel 136 of annular cross-section surrounding the second conduit 130 for blowing a gas shrouding the oxygen-containing gas, the conduits 128, 130, 134 coextending through the bottom wall 22' and the char bed 33 illustrated in FIG. 6. A protective refractory structure 138 of conical configuration surrounds the third conduit 134, the refractory structure 138 and conduit 134 coextending from the bottom wall 22' through the char bed 33.

Figure 18:
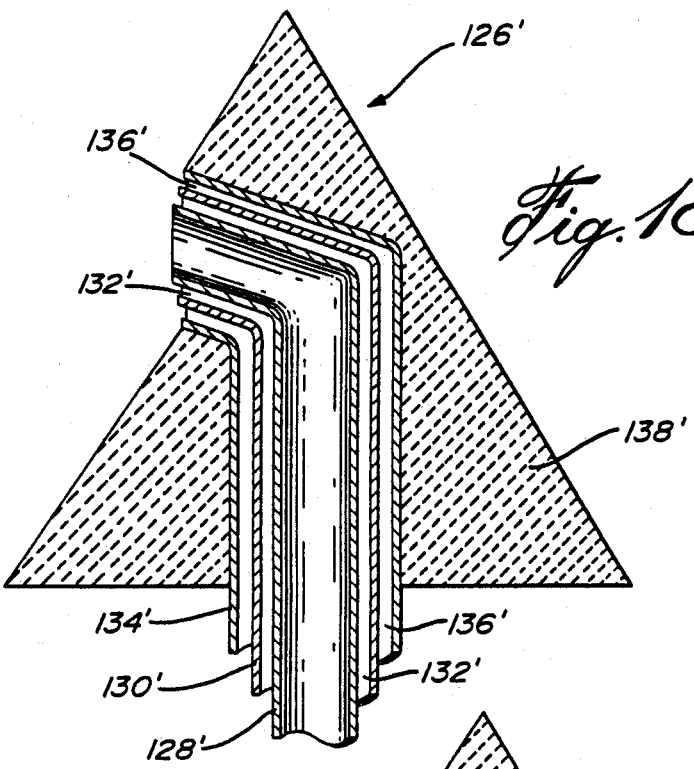
Figs. 17 and 18 are vertical section views illustrating pyramidal-type double and triple conduit injectors, respectively.
Figure 17:
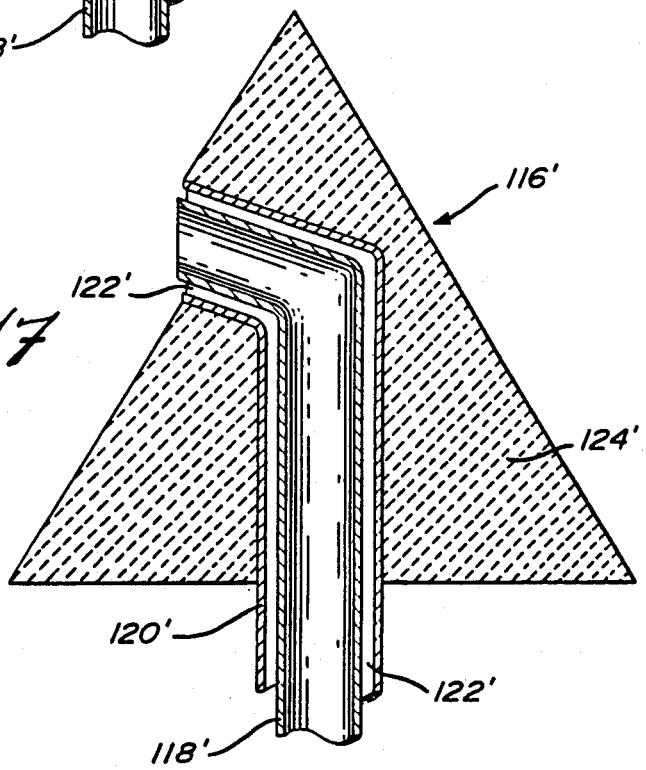

The double and triple conduit injectors 116' and 126' illustrated in FIGS. 17 and 18 are similar to the injectors 116 and 126 described above, except that the protective refractory structures 124' and 138' have a pyramidal configuration and the conduits are arranged such that their gas discharge orifices are provided in one of the sidewalls of the pyramidal structure.

The pyramidal-type double conduit injector 116' shown in FIG. 17 comprises a first tubular conduit 118' of temperature and corrosion resistant metal for blowing the oxygen-containing gas and a second tubular conduit 120' of temperature and corrosion resistant metal concentrically arranged with, respect to the first conduit 118' to define a channel 122' of annular cross-section surrounding the first conduit 118' for blowing a ,gas shrouding the oxygen-containing gas, the, conduits 118', 120' coextending through the bottom wall 22' and char bed 33 illustrated in FIG. 6. A protective refractory structure 124' of pyramidal configuration surrounds the second conduit 120' the refractory structure 124' and conduit 120' coextending from the bottom wall 22' through the char bed 33.

The pyramidal-type triple conduit injector 126' illustrated in FIG. 18, on the other hand, comprises a first tubular conduit 128' of temperature and corrosion resistant metal for pneumatically injecting a solid oxygen-reactive material in particulate form with a carrier gas which is non-reactive to the oxygen reactive material, a second tubular conduit 130' of temperature and corrosion resistant metal concentrically arranged with respect to the first conduit 128' to define a first channel 132' of annular cross-section surrounding the first conduit 128' for blowing the oxygen-containing gas, and a third tubular conduit 134' of temperature and corrosion resistant metal concentrically arranged with respect to the second conduit 130' to define a second channel 136' of annular cross-section surrounding the second conduit 130' for blowing a gas shrouding the oxygen-containing gas, the conduits 128', 130', 134' coextending through the bottom wall 22' and the char bed 33 illustrated in FIG. 6. A protective refractory structure 138' of pyramidal configuration surrounds the third conduit 134', the refractory structure 138' and conduit 134' coextending from the bottom wall 22' through the char bed 33.

We claim:

1. A method of improving combustion in a steam generating boiler having a bottom wall supporting a char bed and sidewalls with ports through which air is admitted for combustion species in the char bed and emanating therefrom, which comprises introducing an oxygen-containing gas into a lower central zone of the boiler, from at least one point remote from said sidewalls and from said char bed to thereby cause intimate mixing of the oxygen contained in said gas with said combustible species, said oxygen-containing gas being blown downwardly from an upper section of the boiler at a distance from said char bed sufficient to avoid oxidation of spent chemicals contained in said char bed.

2. A method as claimed in claim 1, wherein said oxygen-containing gas is air.

3. A method as claimed in claim 1, wherein said oxygen-containing gas is oxygen-enriched air.

4. A method as claimed in claim 1, wherein said oxygen-containing gas is commercial $O_2$ having a molecular oxygen content between about 90 and about 99.5% by volume.

5. A method as claimed in claim 1, wherein said oxygen-containing gas comprises a mixture of oxygen with at least one other gas selected from the group consisting of $N_2$, $N_2O$, $CO_2$, CO, $CH_4$, $C_3H_8$, natural gas, flue gases and $H_2O$ vapour.

6. A method as claimed in claim 1, wherein said oxygen-containing gas is substantially nitrogen-free.

7. A method as claimed in claim 6, wherein said oxygen-containing gas has a nitrogen content of less than about 4% by volume.

8. A method as claimed in claim 1, wherein up to about 60% of the total oxygen requirement is introduced non-peripherally, the balance being supplied in the form of air introduced peripherally through said sidewall ports.

9. A method as claimed in claim 1, wherein said oxygen-containing gas is blown downwardly by means of at least one elongated lance arranged in said upper section and extending downwardly to discharge through at least one orifice thereof at least one stream of said oxygen-containing gas, remotely from said sidewalls.

10. A method as claimed in claim 9, wherein use is made of a single lance to blow said oxygen-containing gas, said lance extending vertically and centrally of said boiler.

11. A method as claimed in claim 9, wherein use is made of a single lance to blow said oxygen-containing gas, said lance being angularly inclined.

12. A method as claimed in claim 9, wherein use is made of a plurality of lances to blow said oxygen-containing gas, said lances being evenly distributed relative to a central vertical axis of said boiler.

13. A method as claimed in claim 9, wherein use is made of a plurality of lances to blow said oxygen-containing gas, said lances extending in a common plane, in spaced-apart parallel relationship.

14. A method as claimed in claims 12 or 13, wherein said lances extend vertically.

15. A method as claimed in claim 13, wherein said lances are angularly inclined.

16. A method of improving combustion in a steam generating boiler having a bottom wall supporting a char bed and sidewalls with ports through which air is admitted for combustion of combustible species in the char bed and emanating therefrom, which comprises introducing an oxygen-containing gas into a lower central zone of the boiler, from at least one point remote from said sidewalls to thereby cause intimate mixing of the oxygen contained in said gas with said combustible species, said oxygen-containing gas being blown upwardly from above said char bed.

17. A method as claimed in claim 16, wherein said oxygen-containing gas is blown upwardly by means of at least one injector arranged on said bottom wall remotely from said sidewalls and extending through said char bed.

18. A method as claimed in claim 17, wherein said oxygen-containing gas is blown upwardly by means of a single injector disposed centrally of said boiler.

19. A method as claimed in claim 17, wherein said oxygen-containing gas is blow upwardly by means of a plurality of injectors.

20. A method as claimed in claim 19, wherein said injectors are arranged to impart a swirling motion to said oxygen-containing gas.

21. A method as claimed in claim 1, wherein particulate solids are pneumatically injected together with said oxygen-containing gas.

22. A method as claimed in claim 21, wherein said solids are supplied as seeds to cause agglomeration of volatilized inorganic matter.

23. A method, of improving combustion in a steam generating boiler having a bottom wall supporting a char bed and sidewalls with ports through which air is admitted for combustion of combustible species in the char bed and emanating therefrom, which comprises introducing an oxygen-containing gas into a lower central zone of the boiler, from at least one point remote from said sidewalls to thereby cause intimating mixing of the oxygen contained in said gas with said combustible species, and pneumatically injecting particulate solids as seeds together with said oxygen-containing gas to cause agglomeration of volatized inorganic matter, said particulate solids comprising particles of sodium sulfate. or char bed temperature.

24. A method as claimed in claim 22, wherein said solids are supplied as a source of heat to control furnace 25. A method as claimed in claim 24, wherein said ate solids comprise particles of a carbonaceous material.

26. A method of improving combustion in a steam generating boiler having a bottom wall supporting a char bed and sidewalls with ports through which air is admitted for combustion of combustible species in the char bed and emanating therefrom, which comprises introducing an oxygen-containing gas into a lower central zone of the boiler, from at least one point remote from said sidewalls to thereby cause intimate mixing of the oxygen contained in said gas with said combustible species, and pneumatically injecting a solid oxygen reactive material in particulate form into said boiler separately of said oxygen containing gas, by means of a carrier gas which is non-reactive to said oxygen reactive material.

27. A method as claimed in claim 26, wherein said carrier gas is a hydrocarbon gas or a gaseous mixture of hydrogen, carbon monoxide and hydrocarbons.

28. A method of improving combustion in a steam generating boiler having a bottom wall supporting a char bed and sidewalls with ports through which air is admitted for combustion of combustible species in the char bed and emanating therefrom, which comprises introducing an oxygen-containing gas into a lower central zone of the boiler, from at least one point remote from said sidewalls to thereby cause intimate mixing of the oxygen contained in said gas with said combustible species, and injecting a solid oxygen reactive material in particulate form into said boiler by means of a liquid hydrocarbon.

29. A method as claimed in claims 26 or 28, wherein said particulate oxygen reactive material comprises particles of a carbonaceous material and is supplied as a source of heat to control furnace or char bed temperature.

30. A method as claimed in claims 1 or 16, wherein said oxygen-containing gas is introduced at a pressure ranging from about 1 to about 10 atm. abs.

31. A method as claimed in claims 1 or 16, wherein said oxygen-containing gas is introduced at a pressure ranging from about 1.2 to about 5 atm. abs.

32. A method as claimed in claims 1 or 16, wherein said oxygen-containing gas has a velocity ranging from about 1 ft/sec to over sonic velocity.

33. A method as claimed in claim 1 or 16, wherein said oxygen-containing gas has a velocity ranging from about 10 to about 1000 ft/sec.

34. In a steam generating boiler having a bottom wall supporting a char bed and sidewalls with ports through which air is admitted for combustion of combustible species in the char bed and emanating therefrom, the improvement which comprises means for blowing an oxygen-containing gas into a lower central zone of the boiler, from at least one point remote from the upper portion thereof and from said sidewalls to thereby cause intimate mixing of the oxygen contained in said gas with said combustible species.

35. A steam generating boiler as claimed in claim 34, wherein said gas blowing means is adapted to blow said oxygen-containing gas downwardly from an upper section of the boiler.

36. A steam generating boiler as claimed in claim 35, wherein said gas blowing means comprises at least one elongated lance arranged in said upper section and extending downwardly to discharge through at least one orifice thereof at least one stream of said oxygen-containing gas, remotely from said sidewalls.

37. A steam generating boiler as claimed in claim 36, wherein said at least one lance is angularly inclined.

38. A steam generating boiler as claimed in claim 36, wherein there is a single lance extending vertically and centrally of the boiler.

39. A steam generating boiler as claimed in claim 36, wherein there is a plurality of lances evenly distributed relative to a central vertical axis of said boiler.

40. A steam generating boiler as claimed in claim 36, wherein there is a plurality of lances extending in a common plane, in spaced-apart parallel relationship.

41. A steam generating boiler as claimed in claims 39 or 40, wherein said lances extend vertically.

42. A steam generating boiler as claimed in claims 39 or 40, wherein said lances are angularly inclined.

43. In a steam generating boiler having a bottom wall supporting a char bed and sidewalls with ports through which air is admitted for combustion of combustible species in the char bed and emanating therefrom, the improvement which comprises means for blowing an oxygen-containing gas downwardly from an upper section of the boiler into a lower central zone of the boiler, from at least one point remote from said sidewalls to thereby cause intimate mixing of the oxygen contained in said gas with said combustible species, said gas blowing means comprising at least one elongated lance arranged in said upper section and extending downwardly to discharge through a plurality of gas discharge orifices a plurality of streams of said oxygen-containing gas, remotely from said sidewalls, said gas discharge orifices being spaced from one another and each oriented at an angle not greater than about 60° relative to the longitudinal axis of the lance.

44. A steam generating boiler as claimed in claim 43, wherein said at least one lance is provided with three gas discharge orifices equidistantly spaced from one another and each oriented at an angle of about 45° relative to said longitudinal axis.

45. In a steam generating boiler having a bottom wall supporting a char bed and sidewalls with ports through which air is admitted for combustion of combustible species in the char bed and emanating therefrom, the improvement which comprises means for blowing am oxygen containing gas downwardly from an upper section of the boiler into a lower central zone of the boiler, from at least one point remote from said sidewalls to thereby cause intimate mixing of the oxygen contained in said gas with said combustible species, said gas blowing means comprising at least one water-cooled lance arranged in said upper section and extending downwardly to discharge through at least one orifice thereof at least one stream of said oxygen-containing gas, remotely from said sidewalls.

46. In a steam generating boiler having a bottom wall supporting a char bed and sidewalls with ports through which air is admitted for combustion of combustible species in the char bed and emanating therefrom, the improvement which comprises means for blowing an oxygen-containing gas downwardly from an upper section of the boiler into a lower central zone of the boiler, from at least one point remote from said sidewalls to thereby cause intimate mixing of the oxygen contained in said gas with said combustible species, said gas blowing means comprising at least one elongated lance arranged in said upper section and extending downwardly to discharge through at least one orifice thereof at least one stream of said oxygen-containing gas, remotely from said sidewalls, said at least one lance comprising a first tubular conduit for blowing said oxygen-containing gas and a second tubular conduit concentrically arranged with respect to said first conduit to define a channel of annular cross-section surrounding said first conduit for blowing a gas shrouding said oxygen-containing gas.

47. A steam generating boiler having a bottom wall supporting a char bed and sidewalls with ports through which air is admitted for combustion of combustible species in the char bed and emanating therefrom, the improvement which comprises means for blowing an oxygen-containing gas into a lower central zone of the boiler, from at least one point remote from said sidewalls to thereby cause intimate mixing of the oxygen contained in said gas with said combustible species, said gas blowing means being adapted to blow said oxygen-containing gas upwardly from above said char bed.

48. A steam generating boiler as claimed in claim 47, wherein said gas blowing means comprises at least one injector arranged on said bottom wall remotely from said sidewalls and extending through said char bed.

49. A steam generating boiler as claimed in claim 48, wherein said injector comprises a single conduit of temperature and corrosion resistant metal.

50. A steam generating boiler as claimed in claim 48, wherein said injector comprises a first tubular conduit of temperature and corrosion resistant metal for blowing said oxygen-containing gas and a second tubular conduit of temperature and corrosion resistant metal concentrically arranged with respect to said first conduit to define a channel of annular cross-section surrounding said first conduit for blowing a gas shrouding said oxygen-containing gas, said first and second conduits coextending through said bottom wall and said char bed.

51. A steam generating boiler as claimed in claim 48, wherein said injector comprises an elongated conduit of temperature and corrosion resistant metal extending through said bottom wall, and a protective refractory structure surrounding said conduit, said conduit and refractory structure coextending from said bottom wall through said char bed.

52. A steam generating boiler as claimed in claim 51, wherein said refractory structure has a conical configuration defining an apex, and wherein said conduit has a gas discharge orifice provided at said apex.

53. A steam generating boiler as claimed in claim 51, wherein said refractory structure has a pyramidal configuration defining four upwardly converging sidewalls, and wherein said conduit has at least one gas discharge orifice provided in at least one of said upwardly converging sidewalls.

54. A steam generating boiler as claimed in claim 48, wherein said injector comprises a first tubular conduit of temperature and corrosion resistant metal for blowing said oxygen-containing gas and a second tubular conduit of temperature and corrosion resistant metal concentrically arranged with respect to said first conduit to define a channel of annular cross-section surrounding said first conduit for blowing a gas shrouding said oxygen-containing gas, said first and second conduits coextending through said bottom wall and said char bed, and wherein a protective refractory structure surrounds said second conduit, said refractory structure and said second conduit coextending from said bottom wall through said char bed.

55. A steam generating boiler as claimed in claim 54, wherein said refractory structure has a conical configuration defining an apex, and wherein said conduits each have a gas discharge orifice provided at said apex.

56. A steam generating boiler as claimed in claim 54, wherein said refractory structure has a pyramidal configuration defining four upwardly converging sidewalls, and wherein said conduits each have at least one gas discharge orifice provided in at least one of said upwardly converging sidewalls.

57. A steam generating boiler as claimed in claim 48, wherein there is a single injector disposed centrally of the boiler.

58. A steam generating boiler as claimed in claim 48, wherein there is a plurality of injectors arranged to impart a swirling motion to said oxygen-containing gas.

59. An injector for use in a steam generating boiler having a bottom wall supporting a char bed and sidewalls with ports through which air is admitted for combustion of combustible species in the char bed and emanating therefrom, said injector being mountable on said bottom wall remotely from said sidewalls for blowing an oxygen-containing gas into a lower central zone of said boiler and comprising an elongated conduit of temperature and corrosion resistant metal extending through said bottom wall, and a protective refractory structure surrounding said conduit, said conduit and refractory structure coextending from said bottom wall through said char bed.

60. An injector as claimed in claim 59, wherein said refractory structure has a conical configuration defining an apex, and wherein said conduit has a gas discharge orifice provided at said apex.

61. An injector as claimed in claim 59, wherein said refractory structure has a pyramidal configuration defining four upwardly converging sidewalls, and wherein said conduit has at least one gas discharge orifice provided in at least one of said upwardly converging sidewalls.

62. An injector as claimed in claim 59, wherein said conduit is made of a ferrous alloy.

63. An injector as claimed in claims 59 or 62, wherein said refractory structure is made of a refractory material selected from the group consisting of alumina, silica, silicon carbide, magnesite and chrome-magnesite.

64. An injector for use in a steam generating boiler having a bottom wall supporting a char bed and sidewalls with ports through which air is admitted for combustion of combustible species in the char bed and emanating therefrom, said injector being mountable on said bottom wall remotely from said sidewalls for blowing an oxygen-containing gas into a lower central zone of said boiler and comprising a first tubular conduit of temperature and corrosion resistant metal for blowing said oxygen-containing gas, a second tubular conduit of temperature and corrosion resistant metal concentrically arranged with respect to said first conduit to define an annular channel between said conduits for blowing a gas shrouding said oxygen-containing gas, said first and second conduits coextending through said bottom wall and said char bed, and a protective refractory structure surrounding said second conduit, said refractory structure and said second conduit coextending from said bottom wall through said char bed.

65. An injector as claimed in claim 64, wherein said refractory structure has a conical configuration defining an apex, and wherein said conduits each have a gas discharge orifice provided at said apex.

66. An injector as claimed in claim 64, wherein said refractory structure has a pyramidal configuration defining four upwardly converging sidewalls, and wherein said conduits each have at least one gas discharge orifice provided in at least one of said upwardly converging sidewalls.

67. An injector as claimed in claim 64, wherein said conduits are made of ferrous alloy.

68. An injector for use in a steam generating boiler having a bottom wall supporting a char bed and sidewalls with ports through which air is admitted for combustion of combustible species in the char bed and emanating therefrom, said injector being mountable on said bottom wall remotely from said sidewalls for blowing an oxygen-containing gas into a lower central zone of said boiler and comprising a first tubular conduit of temperature and corrosion resistant metal for pneumatically injecting a solid oxygen reactive material in particulate form with a carrier gas which is non-reactive to said oxygen reactive material, a second tubular conduit of temperature and corrosion resistant metal concentrically arranged with respect to said first conduit to define a first channel of annular cross-section surrounding said first conduit for blowing said oxygen-containing gas, and a third tubular conduit of temperature and corrosion resistant metal concentrically arranged with respect to said second conduit to define a second channel of annular cross-section surrounding said second conduit for blowing a gas shrouding said oxygen-containing gas, said first, second and third conduits coextending through said bottom wall and said char bed.

69. An injector as claimed in claim 68, wherein a protective refractory structure surrounds said third conduit, said refractory structure and said third conduit coextending from said bottom wall through said char bed.

70. An injector as claimed in claim 69, wherein said refractory structure has a conical configuration defining an apex, and wherein said conduits each have a gas discharge orifice provided at said apex.

71. An injector as claimed in claim 69, wherein said refractory structure has a pyramidal configuration defining four upwardly converging sidewalls, and wherein said conduits each have at least one gas discharge orifice provided in at least one of said upwardly converging sidewalls.

72. An injector as claimed in claim 68, wherein said conduits are made of ferrous alloy.

73. An injector as claimed in claims 64 or 69, wherein said refractory structure is made of a refractory silica, silicon carbide, magnesite and chrome-magnesite. material selected from the group consisting of alumina, silica, silicon carbide, magesite and chrome-magnesite.

74. An injector as claimed in claims 62, 67 or 72, wherein said ferrous alloy is stainless steel.

75. A method according to claim 16, wherein said oxygen-containing gas is air.

76. A method according to claim 16, wherein said oxygen-containing gas is oxygen-enriched air.

77. A method according to claim 16, wherein said oxygen-containing gas is commercial $O_2$ having a molecular oxygen content between about 90 and about 99.5% by volume.

78. A method according to claim 16, wherein said oxygen-containing gas comprises a mixture of oxygen with at least one other gas from the group consisting of $N_2$, $N_2O$, $CO_2$, CO, $CH_4$, $C_3H_8$, natural gas, flue gases and $H_2O$ vapour.

79. A method according to claim 16, wherein said oxygen-containing gas is substantially nitrogen-free.

80. A method according to claim 79, wherein said oxygen-containing gas has a nitrogen content of less than about 4% by volume.

81. A method according to claim 16, wherein up to about 60% of the total oxygen requirement is introduced non-peripherally, the balance being supplied in the form of air introduced peripherally through said sidewall ports.

* * * * *